US006385784B1

(12) United States Patent
Donohue

(10) Patent No.: US 6,385,784 B1
(45) Date of Patent: May 14, 2002

(54) TOILET BOWL SPLATTER SHIELD

(76) Inventor: Joseph Guy Donohue, 3811 E. 74th St., Tulsa, OK (US) 74136

( * ) Notice: Subject to any disclaimer, the term of this patent is extended or adjusted under 35 U.S.C. 154(b) by 0 days.

(21) Appl. No.: 09/779,685

(22) Filed: Feb. 8, 2001

(51) Int. Cl.[7] ..... E03D 9/00
(52) U.S. Cl. ..... 4/300.3; 4/DIG. 5; 4/420
(58) Field of Search ..... 4/300.3, DIG. 5, 4/314, 420, 661, 902

(56) References Cited

U.S. PATENT DOCUMENTS

| | | | | | |
|---|---|---|---|---|---|
| 2,931,047 | A | * | 4/1960 | Stebbins | 4/300.3 |
| 3,614,790 | A | * | 10/1971 | Billingsly et al. | 4/300.3 |
| 4,215,443 | A | * | 8/1980 | Babik | 4/300.3 |
| 5,930,847 | A | * | 8/1999 | Hall | 4/300.3 |

* cited by examiner

*Primary Examiner*—Robert M. Fetsuga
*Assistant Examiner*—Huyen Le
(74) *Attorney, Agent, or Firm*—Frank J. Catalano

(57) ABSTRACT

A shield for a toilet has a shaft adapted at one end to be fixed to an inner wall of the toilet bowl. The shaft extends horizontally into the bowl. A sleeve is mounted for rotation on the shaft. An arm extends from the sleeve inwardly and downwardly into the bowl. A strike pad is mounted on the end of the arm in an approximately horizontal position above the standing water level. A lever extending upwardly form the sleeve is engagable against the underside of the seat for angular displacement of the sleeve during rotation of the seat into the down position to move the strike pad to an approximately vertical storage position at the rear of the bowl and is disengagable from the underside of the seat during rotation of the seat to the up position to allow the strike pad to move to an approximately horizontal use position.

3 Claims, 4 Drawing Sheets

TOILET BOWL SPLATTER SHIELD

BACKGROUND OF THE INVENTION

This invention relates generally to bathroom accessories and more particularly concerns a splatter shield for a typical household toilet.

When men use a typical household toilet, inaccurate aim or, more often, splattering leaves the toilet area in an unpleasant and unsanitary condition. The problem is exacerbated during nocturnal visits because, whether for their own comfort or perhaps out of courtesy to others in adjoining sleeping areas, men frequently choose not to use the bathroom light. The position of the toilet is trusted to feel and sound rather than sight. In darkness, a man will generally determine by the touch of his legs whether the seat is up or down and the position of the bowl. The rest is left to sound. A shield properly positioned in the bowl could assist in the detection of accuracy and also reduce the possibility of splatter. Such a shield, however, could not be permanently located for obvious reasons. On the other hand, the need to position or reposition the shield in the dark would introduce new problems.

It is, therefore, an object of this invention to provide a household toilet splatter shield which visually and audibly confirms the accuracy during use of the toilet by men. Another object of this invention is to provide a household toilet splatter shield which reduces splattering during use of the toilet by men. A further object of this invention is to provide a household toilet splatter shield which is automatically repositioned in the toilet bowl in response to the repositioning of the toilet seat. Yet another object of this invention is to provide a household toilet splatter shield which is automatically positioned in an approximately horizontal use position when the seat is in an up position. It is also an object of this invention to provide a household toilet splatter shield which is automatically positioned at an approximately vertical storage position at the rear of the bowl when the seat is in a down position. Still another object of this invention is to provide a household toilet splatter shield which is easily adaptable for use in variously shaped toilets. An additional object of this invention is to provide a household toilet splatter shield which is reversible for attachment to either side of the bowl. Another object of this invention is to provide a household toilet splatter shield which is self-cleaning during the normal toilet bowl flush operation.

SUMMARY OF THE INVENTION

In accordance with the invention, a shield is provided for a toilet on which a seat is hinged for rotation between a down position on the rim of the toilet bowl and an up position angularly displaced from the rim of the toilet bowl. A shaft is adapted at one end to be fixed to an inner wall of the bowl. The shaft extends horizontally into the bowl above the standing water level. A sleeve is mounted for rotation on the shaft. An arm extends from the sleeve inwardly and downwardly into the bowl to an end above the standing water level. A strike pad is mounted in an approximately horizontal position on the end of the arm. A lever extends upwardly from the sleeve. The lever is engagable against the underside of the seat for angular displacement of the sleeve in response to force exerted on the lever by the seat during rotation of the seat into the down position. The rotating sleeve moves the strike pad to an approximately vertical position at the rear of the bowl. The lever is disengagable from the underside of the seat during rotation of the seat to the up position. This permits angular displacement of the sleeve in response to gravitational force exerted on the strike pad. This allows the strike pad to return to an approximately horizontal position.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
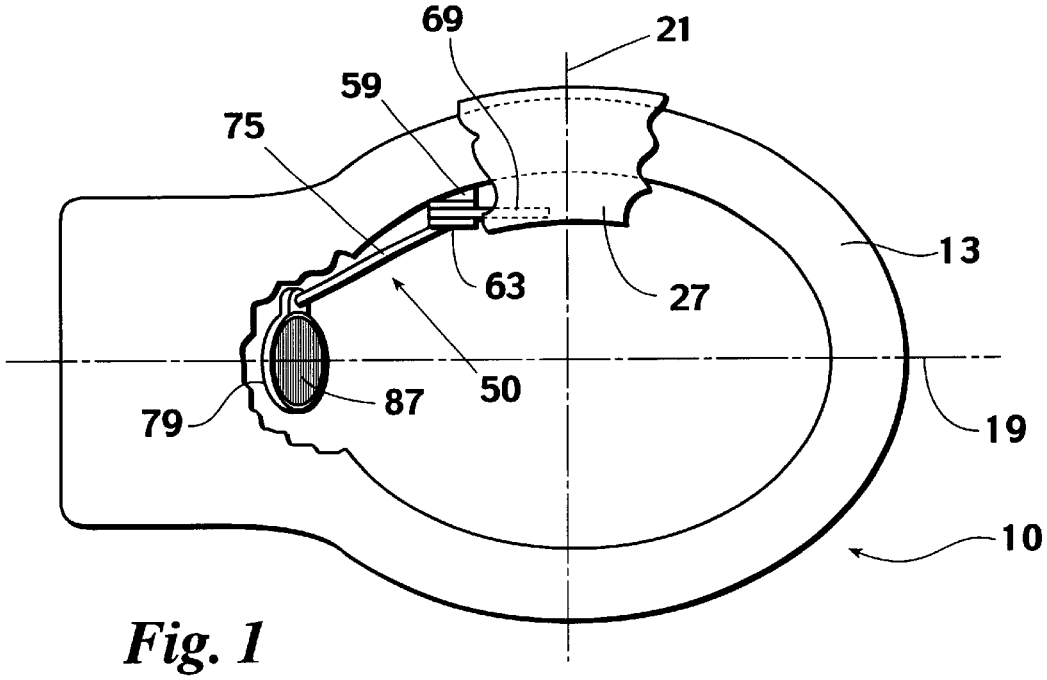
FIG. 1 is a top plan view with parts broken away of a preferred embodiment of the shield installed in a typical household toilet with its seat in the down position.
Figure 2:
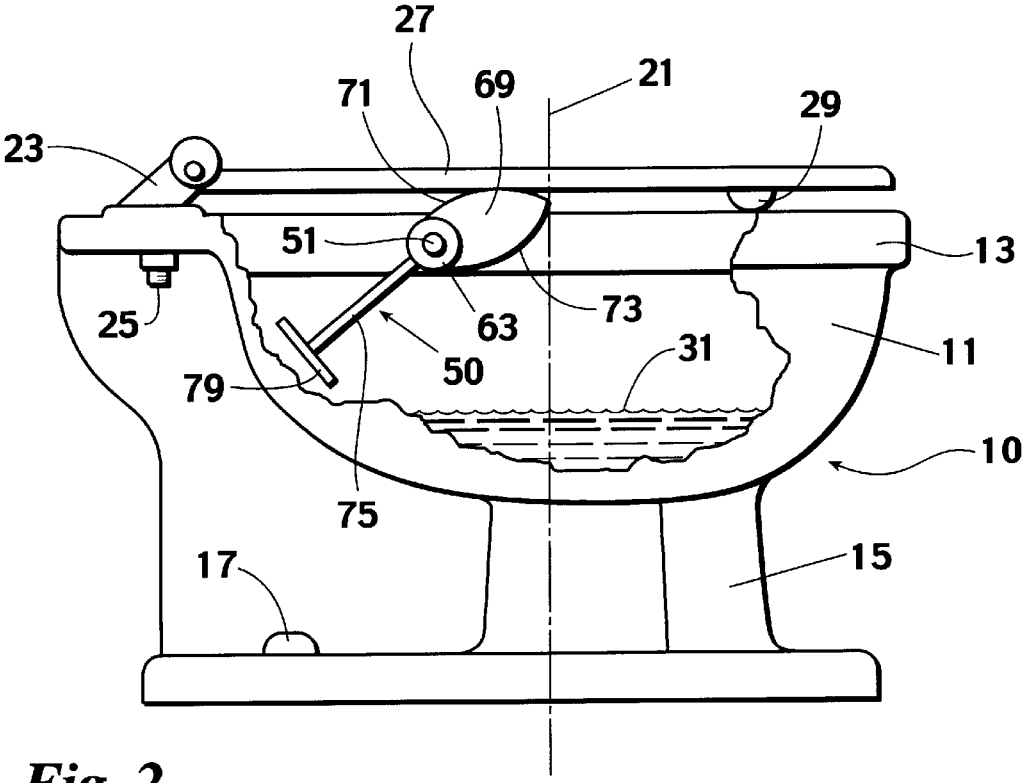
FIG. 2 is a side elevation view with parts broken away of the toilet and shield of FIG. 1.
Figure 3:
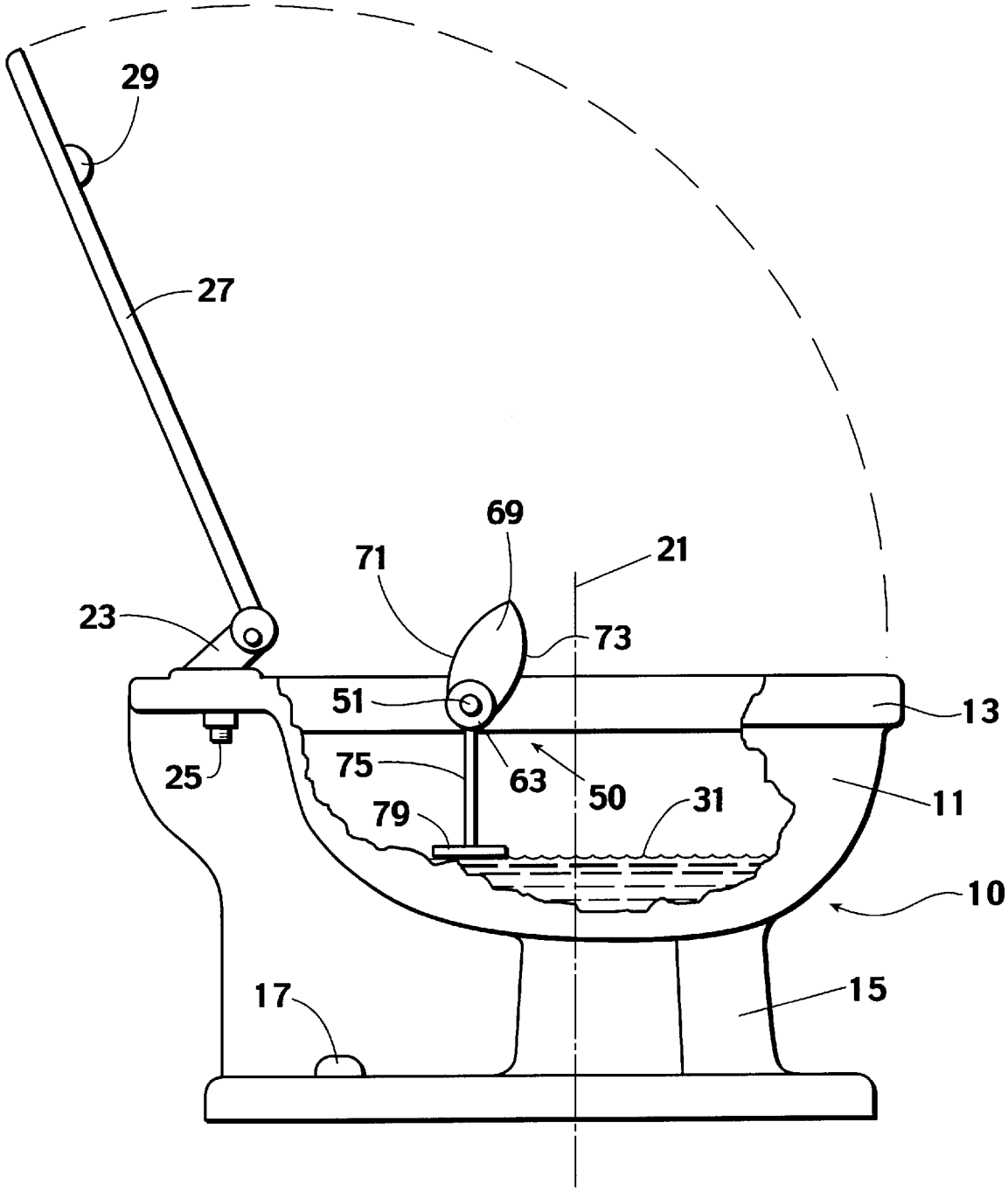
FIG. 3 is a side elevation view with parts broken away of the toilet and shield of FIG. 1 with the seat in the up position.
Figure 4:
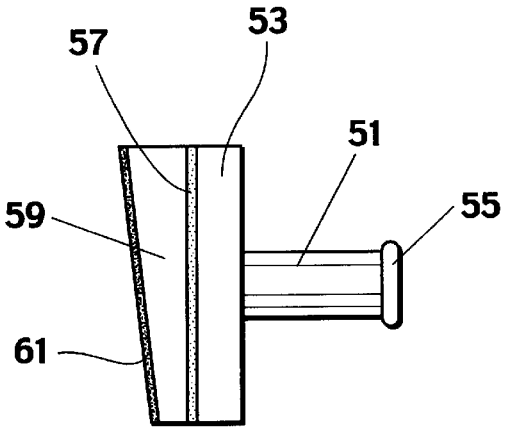
FIG. 4 is a side elevation view of the shaft and adapter of the shield of FIG. 1.
Figure 5:
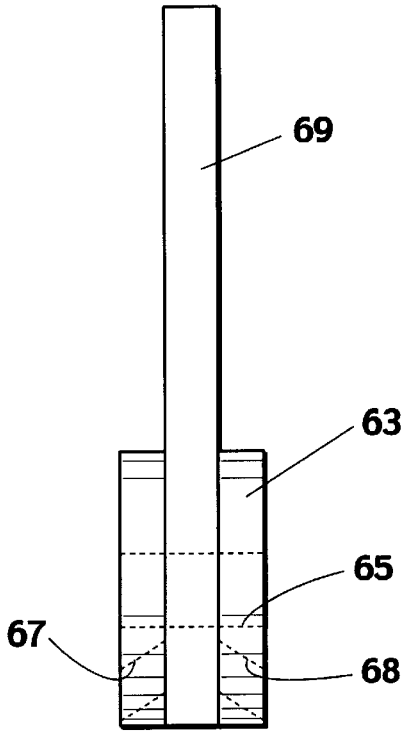
FIG. 5 is a side elevation view of the sleeve and lever of the shield of FIG. 1.
Figure 6:
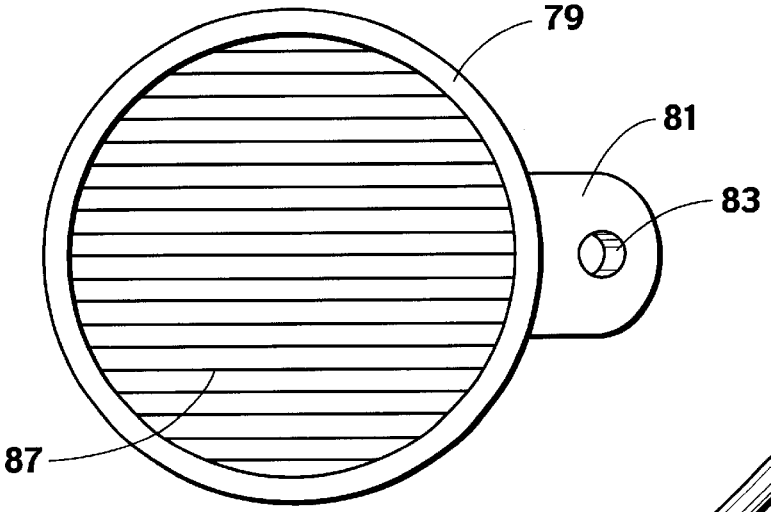
FIG. 6 is a top plan view of the strike pad of the shield of FIG. 1.
Figure 7:
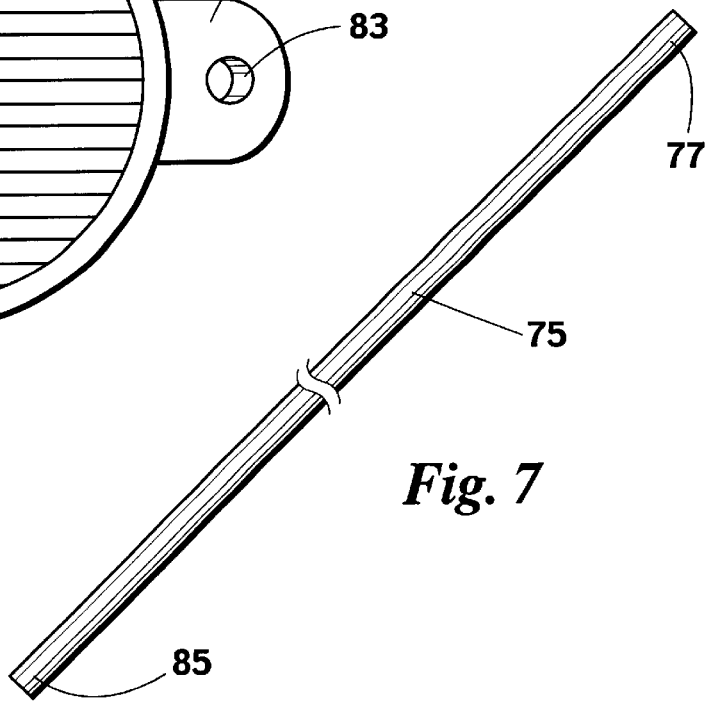
FIG. 7 is a side elevation view of the arm of the shield of FIG. 1.

Turning first to FIGS. 1 through 3, a typical household toilet 10 in which the toilet bowl shield 50 will be used is illustrated. The toilet 10 has a bowl 11 with an upper rim 13. The bowl 11 rests on a support 15 which is secured to the floor by bolts 17. As shown, the bowl 11 has an oval shape with a longitudinal axis 19 and a transverse axis 21. Posts 23 extending upwardly from the rear of the bowl and secured in place by cover bolts 25 hinge the toilet seat 27. The seat 27 is held in horizontal position parallel to the rim 13 of the toilet 10 by the posts 23 and by bumpers 29 on the underside of the seat proximate its forward end. In its normal condition, the bowl 11 stores water at a threshold standing water level 31. In the flushing operation of the toilet 10, water inlet to the bowl 11 raises the water level above the threshold level 31 before the contents of the bowl 11 are discharged through the waste system (not shown) and the water level is again returned to its threshold level 31. In FIGS. 1 and 2, the seat 27 is shown in its down position, resting on the rim 13 of the toilet 10. In FIG. 3, the seat 27 is illustrated in its up position, angularly displaced away from the rim 13 of the toilet 10.

Figure 8:
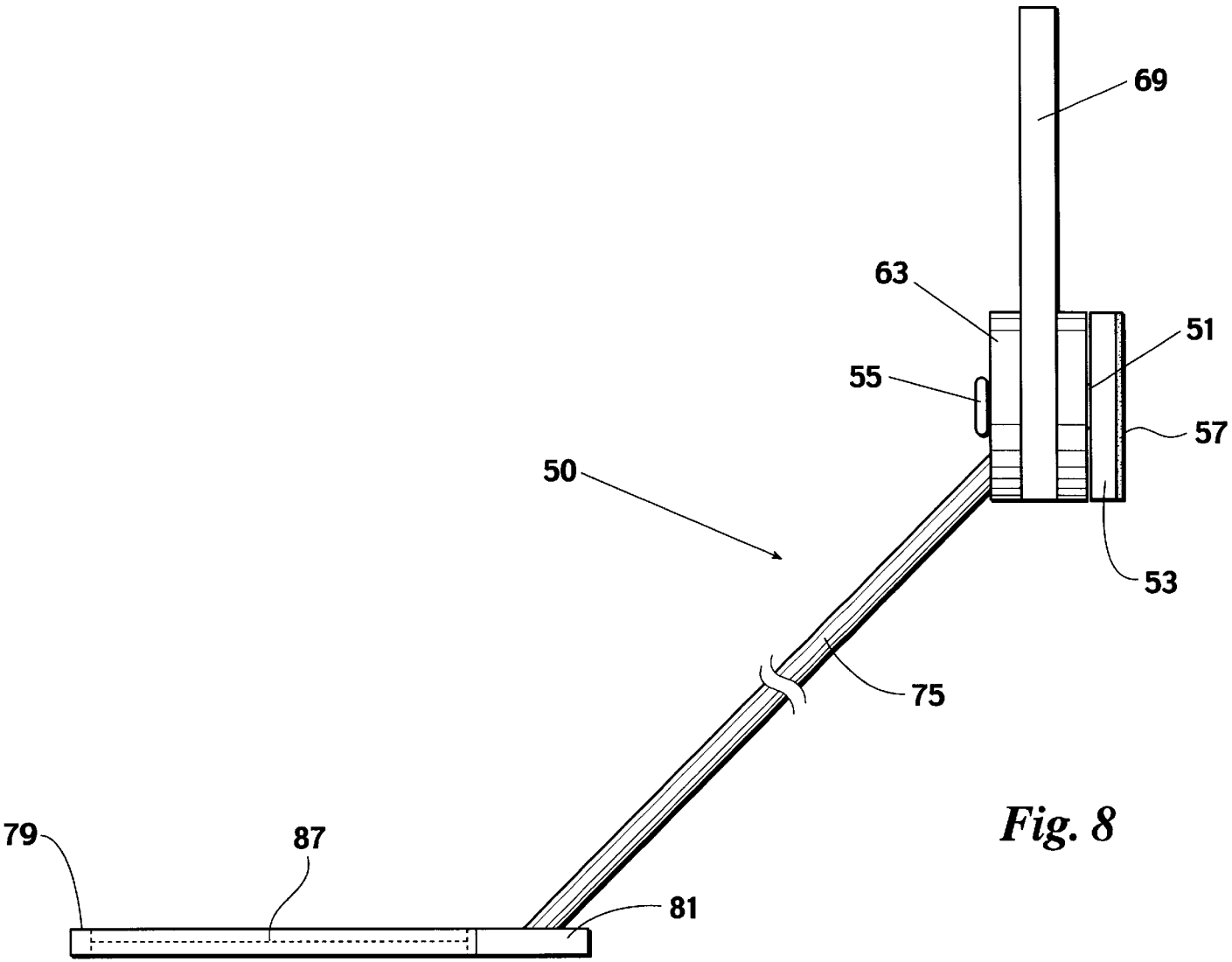
FIG. 8 is a front elevation view of the shield of FIG. 1.

Looking at FIGS. 4 through 8, the shield 50 includes a shaft 51 extending horizontally from a vertical circular base 53. The free end of the shaft 51 has a knurl 55 of slightly greatly diameter than the rest of the shaft 51. Double backed adhesive 57 is applied to the face of the base opposite the shaft 51. Optionally, for reasons hereinafter explained, one or more wedge-shaped disks 59 may be adhered to the double back adhesive 57 and another double backed adhesive 61 applied to the unattached face of the wedge 59. A sleeve 63 having an aperture 65 is rotatively mounted on the shaft 51 with the knurl 55 holding the sleeve 63 in place on the shaft 51. A lever 69 extends radially from the sleeve 63. As may best be seen in FIGS. 2 and 3, the lever 69 is preferably symmetrical with respect to its radial axis on the sleeve 63 and has arcuate cam surfaces 71 and 73 which are mirror images of each other. A cylindrical socket 67 is provided in the sleeve 63 approximately, but not exactly, diametrically opposite the lever 69. Preferably, a second cylindrical socket 68 is symmetrically displaced in the sleeve 63 on the other side of the lower diametric axis. As can best be seen in FIG. 5, the sockets 67 and 68 extend into the sleeve 63 at an angle as will hereinafter be further explained. An arm or rod 75 has one end 77 which press fits into the socket 67 or 68 in the sleeve 63. A frame 79, preferably circular, has a tab 81 extending radially outwardly with a socket 83 in the tab at an angle complementary to the angle of the sleeve sockets 67 or 68. The other end 85 of the rod 75 is press fit into the socket 83 so that the arm 75 connects the frame 79 to the sleeve 63. A strike pad or screen 87 is disposed across the frame 79. Since the angles of the sockets 67 or 68 and 83 are complementary, the strike pad 87 will be maintained parallel to the shaft 51. As is best seen in FIG. 8, with the shaft 55 in horizontal condition, and with no other force applied to the lever 69, the force of gravity will cause the sleeve 63 to rotate so that the rod 75 extends downwardly from the sleeve 73 in a vertical plane with the strike pad 87 in an approximately horizontal condition.

Looking again at FIG. 3, the installation and positioning of the shield 50 in the toilet 10 can be explained. It is first determined which side of the bowl 11 will support the shield 50. The shaft 51 is inserted into the aperture 65 of the sleeve 63, compressing the knurl 55 as it passes through the aperture 65. When the shaft 51 is fully inserted, the knurl 55 expands to lock the sleeve 63 in place on the shaft 51 with the sleeve 63 free to rotate about the shaft 51. The sleeve 63 is positioned against the shaft 51 and the aperture 67 or 68 facing into the bowl 11 is aligned to extend in a vertical plane. If the lever 69 tilts forwardly as can be seen in FIG. 3, the sleeve 63 is mounted in this position. If it leans rearwardly, the sleeve 63 is flipped 180 degrees so that the shaft 51 is inserted through the other side of the aperture 65. This will correctly position the lever 69 for cooperation with the toilet seat 27. The sleeve end 77 of the rod 75 is then press fit into the socket 67 or 68 so that the rod 75 will extend downwardly or into the bowl 11 when the base 53 of the shaft 51 is attached to the inside wall of the bowl 11. The other end 85 of the rod 75 is then press fit through the aperture or socket 83 in the tab 81 of the frame 89. The tab 81 is rotated on the rod 75 so that the frame 79 is approximately horizontal when the rod 75 extends in an approximately vertical plane from the sleeve 63. The rod may be rigid or bendable to permit conformance to individual toilet contour. The base 53 of the shaft 51 is then shifted by the installer along the surface of the inner wall of the bowl 11 until the shaft 55 is approximately parallel to the transverse axis 21 and is close to but rearward of the vertical plane passing through the transverse axis 21. If, due to the curvature of a particular toilet 10, the base 53 cannot be adequately flush with the surface of the bowl 11 when the shaft 55 is in the above described position, the wedges 59 can be positioned between the base 53 and the surface of the bowl 11 and rotated as the base 53 is positioned until a satisfactory compromise is obtained. With the base 53 or, if it is used, the wedge 59, held against the wall of the bowl 11, the rod 75 is marked at a location approximately ¼ inch above the threshold standing water level 31 in the bowl 11. The tab 81 can then be adjusted on the shaft to align with the mark and assure that the strike pad 87 is close to but not in the water in the bowl 11. The portion of the tod 75 extending below the tab 81 can be trimmed with a suitable cutting tool. With the shield 50 thus assembled, the base 53 or wedge 59 can be adhered to the selected position on the inner wall of the bowl 11 by use of the double backed adhesives 57 or 61, respectively.

Thus installed, as is best seen in FIG. 3, when the seat 27 is in the up position the sleeve 63 will be angularly displaced in response to gravitational force exerted on the strike pad 87 to position the strike pad 37 in approximately a horizontal position above the standing water level 31. As the seat 27 is rotated to its down position as shown in FIG. 2, the bottom surface of the seat 27 will strike the upwardly facing cam surface 71 or 73 of the lever 69. With the lever 69 engaged against the underside of the seat 27, as the seat 27 is fully lowered to its horizontal position, the sleeve 63 will be angularly displaced in the response to the force exerted on the lever 69 by the seat 27 to move the strike pad 87 to an approximately vertical position at the rear of the bowl 11. If the seat 27 is again raised, the gravitational force on the strike pad 87 will return to its approximately horizontal position when the seat 27 is fully disengaged form the lever 69.

The terms "approximately horizontal" and "approximately vertical" are used herein in a comparative sense. That is, as will be noted in FIG. 2, while the frame 79 is not truly vertical in the seat down position, it is vertical in comparison to the horizontal relationship achieved when the seat 27 is in the up position as shown in FIG. 3. While in the preferred embodiment, the sleeve 63 is reversible, the separate left and right hand sleeves could be used instead. Furthermore, as earlier suggested, a second wedge 59 could also be used in conjunction with the wedge shown so as to provide more universal adjustment of the plane of the attachment face of the target 50.

Thus, it is apparent that there has been provided, in accordance with the invention, a toilet bowl shield that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A shield for a toilet having a bowl with a standing water level therein and a seat hinged to said bowl for rotation between a down position on a rim of the bowl and an up position angularly displaced from the rim of the bowl comprising a shaft adapted at one end thereof to be fixed to an inner wall of the bowl with said shaft extending horizontally into the bowl above the standing water level, a sleeve mounted for rotation on said shaft, an arm extending from said sleeve inwardly and downwardly into the bowl to an end thereof above the standing water level, a strike pad mounted in an approximately horizontal position on said end of said arm and a lever extending upwardly form said sleeve, said lever being engagable against an underside of the seat for angular displacement of said sleeve in response to force exerted on said lever by the seat during rotation of the seat into the down position to move said strike pad to an approximately vertical position at a rear of the bowl and disengagable from the underside of the seat during rotation of the seat to the up position to permit angular displacement of said sleeve in response to gravitational force exerted ons aid strike pad to return said strike pad to said approximately horizontal position.

2. A shield according to claim 1, said sleeve and said lever being symmetrical in relation to a diametric plane of said sleeve.

3. A shield according to claim 2, said lever having arcurate cam surfaces generated by a line parallel to said diametric plane.

* * * * *